US009915398B2

(12) United States Patent
Kodesh et al.

(10) Patent No.: US 9,915,398 B2
(45) Date of Patent: Mar. 13, 2018

(54) RAPID GAS EXCHANGE AND DELIVERY SYSTEM

(75) Inventors: Zachary L. Kodesh, Tulsa, OK (US); Thomas M. Korb, Owasso, OK (US); Roger L. Poe, Beggs, OK (US)

(73) Assignee: John Zink Company, LLC, Tulsa, OK (US)

( * ) Notice: Subject to any disclaimer, the term of this patent is extended or adjusted under 35 U.S.C. 154(b) by 1396 days.

(21) Appl. No.: 13/472,343

(22) Filed: May 15, 2012

(65) Prior Publication Data

US 2013/0309616 A1 Nov. 21, 2013

(51) Int. Cl.

| | |
|---|---|
| ***F17D 1/04*** | (2006.01) |
| ***F23N 1/00*** | (2006.01) |
| ***F23G 5/50*** | (2006.01) |
| ***F23G 7/08*** | (2006.01) |
| ***F23K 5/00*** | (2006.01) |

(52) U.S. Cl.

CPC ..... *F17D 1/04* (2013.01); *F23G 5/50* (2013.01); *F23G 7/085* (2013.01); *F23K 5/002* (2013.01); *F23N 1/002* (2013.01); *F23G 2207/102* (2013.01); *F23N 2027/04* (2013.01); *Y10T 137/0396* (2015.04)

(58) Field of Classification Search

USPC ..... 431/5, 90

See application file for complete search history.

(56) References Cited

U.S. PATENT DOCUMENTS

| | | | | |
|---|---|---|---|---|
| 2,869,631 | A | 1/1959 | Zink | |
| 3,247,885 | A | 4/1966 | Reed | |
| 3,973,899 | A | 8/1976 | Reed et al. | |
| 4,025,281 | A * | 5/1977 | Lapp | F23G 7/085 422/173 |
| 4,490,106 | A * | 12/1984 | Lazarre | F23G 7/085 431/202 |
| 4,610,622 | A | 9/1986 | Quinnell | |
| 5,022,850 | A * | 6/1991 | Bohon | F23D 14/66 431/199 |
| 5,150,577 | A | 9/1992 | Mitchell et al. | |
| 6,840,761 | B2 | 1/2005 | Hong et al. | |
| 9,267,686 | B1 * | 2/2016 | Little | F23N 5/242 |
| 2003/0036029 | A1 | 2/2003 | Hong et al. | |
| 2010/0183989 | A1 * | 7/2010 | Sanchez-Molinero | F23C 6/045 431/2 |

(Continued)

FOREIGN PATENT DOCUMENTS

JP 2008127009 A 5/2008

OTHER PUBLICATIONS

European Search Report dated May 28, 2015 in corresponding European application No. 13790447.0, John Zink Company, LLC.

(Continued)

*Primary Examiner* — Avinash Savani

*Assistant Examiner* — Martha Becton

(57) ABSTRACT

An apparatus and method are provided for a gas distribution system that allows for the rapid displacement of an extraneous gas in the distribution system by a primary gas. The gas distribution system utilizes a gas accumulator to aid in the rapid displacement of the extraneous gas. In one embodiment a flare pilot system uses the inventive distribution system to allow for the rapid purge of air from the flare pilot system by a fuel.

18 Claims, 8 Drawing Sheets

(56) References Cited

U.S. PATENT DOCUMENTS

| | | | |
|---|---|---|---|
| 2010/0291492 | A1 | 11/2010 | Poe et al. |
| 2012/0015308 | A1 | 1/2012 | Hong et al. |

OTHER PUBLICATIONS

International Search Report and Written Opinion dated Sep. 5, 2013 in corresponding PCT application No. PCT/US2013/039916, John Zink Company, LLC.
Communication pursuant to Article 94(3) EPC—dated Mar. 3, 2016 for Application No. EP20130790447.

* cited by examiner

RAPID GAS EXCHANGE AND DELIVERY SYSTEM

BACKGROUND

1. Field of the Invention

The present invention relates to a method and apparatus for the rapid displacement of one gas by another.

2. Description of the Related Art

In a variety of systems it is desirable to rapidly displace one gas with another. For example in pilot systems it is often necessary to displace air from the pilot systems pipes with a gaseous fuel prior to ignition of the pilot system.

Particularly exemplary pilot systems are those associated with flare stacks. Flare stacks are apparatuses for flaring combustible waste fluid streams. Flare stacks are commonly located at production, refining and other processing plants for disposing of combustible wastes or other combustible streams, which are diverted during venting, shut-downs, upsets and/or emergencies. If the pilots for flare stacks are shut down during times when there is no combustible waste for disposal, the pipes and nozzles associated with the pilots will become inundated with air. Purging the pilots of air has traditionally been a slow process relative to the demands to be able to quickly combust waste fluid streams in times of venting, shutdowns, upsets and/or emergencies. Accordingly, shutting down the pilots can lead to discharge of uncombusted waste to the atmosphere, if they cannot be rapidly relit upon need.

For this reason, such pilots have typically been continuously run, that is the pilots generally remain lit twenty-four hours a day, three hundred sixty-five days a year. Maintaining a continuously lit pilot contributes substantially to the operational cost of the flare stack. Additionally, maintaining a continuously lit pilot adds substantially to the amount of carbon dioxide generated by the flare stack.

Accordingly, to reduce the costs associated with fuel and to lessen environmental impact, there is a desire to have a pilot system that can be quickly purged of air relative to the need to combust waste fluid streams, and hence allow for a pilot that could be fired on an as needed basis.

SUMMARY

In accordance with one embodiment of the present invention, there is provided a method of displacing an extraneous gas with a primary gas in a distribution system comprising:

(a) providing the distribution system having an upstream end and a downstream end and containing the extraneous gas at a first pressure;

(b) introducing the primary gas into the distribution system at the upstream end such that the primary gas flows towards the downstream end, thus defining an upstream direction and a downstream direction, wherein the primary gas is introduced into the distribution system at a second pressure greater than the first pressure; and (c) displacing the extraneous gas by the introduction of the primary gas so that at least a portion of the extraneous gas is displaced into a gas accumulation zone in fluid flow communication with the distribution system and, thus, purged from the distribution system.

In accordance with another embodiment of the invention, there is provided a method of intermittently operating a pilot for igniting flammable fluids discharged from the open end of a flare stack wherein the pilot receives fuel from a pipe having an upstream end in fluid flow communication with a source of fuel and a downstream end in fluid flow communication with the pilot, the method comprising:

(a) shutting down the pilot when no flammable fluids are being discharged from the flare stack and allowing air at a first pressure, which is about atmospheric pressure, to enter the pilot and the pipe;

(b) introducing a fuel from the fuel source to the upstream end of the pipe when flammable fluids need to be discharged from the flare stack; wherein the fuel is introduced at a second pressure greater than atmospheric pressure such that the fuel flows towards the downstream end, thus defining an upstream direction and a downstream direction;

(c) displacing the air by the introduction of the fuel so that at least a portion of the air is displaced into a gas accumulation zone in fluid flow communication with the pipe and, thus, purged from the pipe;

(d) reducing the pressure of the fuel at a point downstream of the downstream end of the pipe such that the pressure of the fuel is about atmospheric; and (e) igniting the fuel as it exits the pilot.

In still a further embodiment, there is provided a distribution system for providing a primary gas to one or more primary gas utilization devices. The distribution system comprises a pipe and one or more gas accumulators. The pipe has an upstream end and a downstream end such that primary gas introduced into the upstream end flows towards the downstream end to thus define an upstream direction and a downstream direction in the pipe and wherein the downstream end is in fluid flow communication with the one or more primary gas utilization devices. The gas accumulators are connected in fluid flow communication to the pipe between the upstream end and the downstream end such that when the primary gas is introduced into the upstream end and flows downstream it pushes at least a portion of any extraneous gas contained in the pipe into the gas accumulators.

In yet another embodiment there is provided a flare pilot system for igniting flammable fluids discharged from the open end of a flare stack. The flare pilot system comprises a fuel source, a pilot, a pipe and a gas accumulator. The fuel source provides a pressurized fuel at a first pressure above atmospheric pressure. The pilot is located adjacent to the open end of the flare stack. The pipe has an upstream end and a downstream end such that fuel introduced into the upstream end flows towards the downstream end to thus define an upstream direction and downstream direction and wherein the upstream end is in fluid flow communication with the fuel source and the downstream end is in fluid flow communication with the pilot. The gas accumulator is in fluid flow communication with the pipe such that when the pressurized fuel is introduced from the fuel source into the upstream end and flows downstream, it pushes at least a portion of any air contained in the pipe into the gas accumulator.

BRIEF DESCRIPTION OF THE DRAWINGS

FIG. 9 is a schematic diagram showing a flare pilot distribution system in accordance with still another embodiment of the current invention. This embodiment utilizes a surge accumulator and a gas accumulator.

FIG. 10 is a schematic diagram showing a flare pilot control system and distribution system in accordance with still another embodiment of the current invention. This embodiment utilizes a surge accumulator and a gas accumulator.

DETAILED DESCRIPTION

Figure 1:
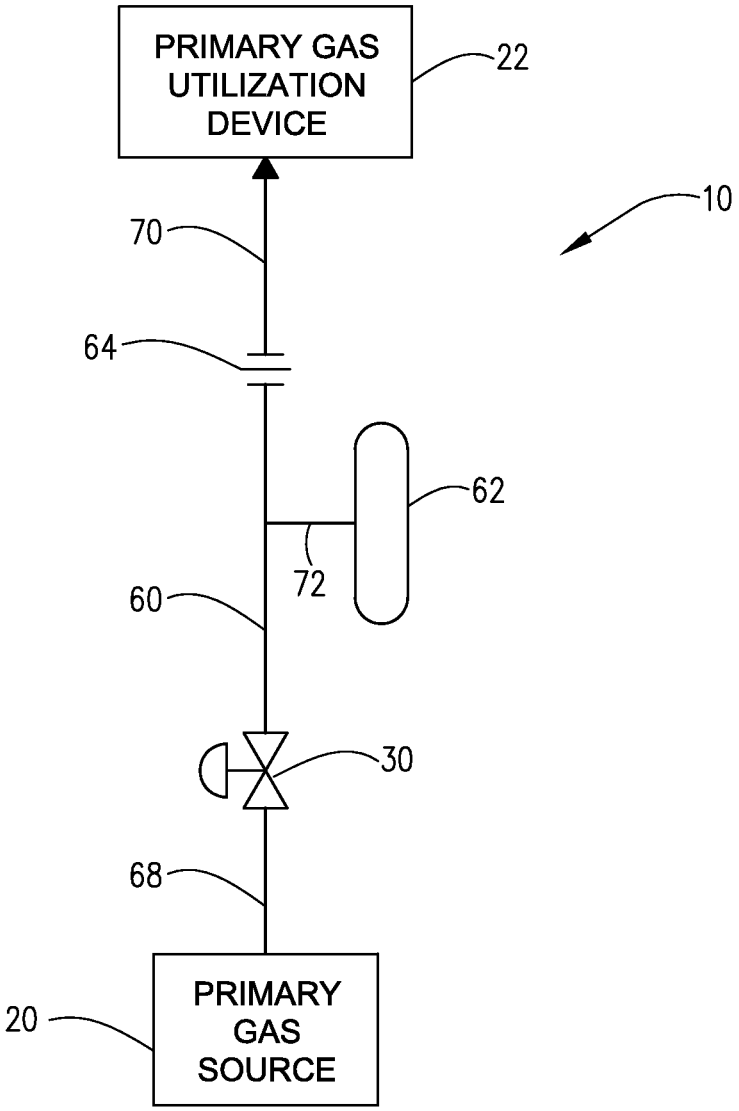
FIG. 1 is a schematic diagram of one embodiment of a distribution system according to the current invention.

Referring now to the drawings, and particularly to FIG. 1, a gas distribution system according to one embodiment of the current invention is illustrated. Distribution system 10 is in fluid flow communication with primary gas source 20 and primary gas utilization system 22 and is designed to deliver the primary gas to primary gas utilization and at a desired pressure while simultaneously purging or displacing an extraneous gas from pipe 60.

Distribution system 10 is comprised of pipe 60, gas accumulator 62 and, optionally, pressure reducing device 64. Pipe 60 has an upstream end 68 and a downstream end 70. A primary gas from primary gas source 20 is introduced into pipe 60 at upstream end 68 and flows towards downstream end 70, thus defining an upstream direction (towards upstream end 68) and downstream direction (towards downstream end 70). Flow from primary gas source 20 is controlled by valve 30, which has an on position that allows flow and an off position that prevents flow of the primary gas into pipe 60. Pipe 60 is in fluid flow communication at downstream end 70 with a primary gas utilization system 22.

Gas accumulator 62 is connected in fluid flow communication to the pipe 60 between upstream end 68 and downstream end 70. It is advantageous in the inventive distribution system that gas accumulator 62 be located towards downstream end 70 but upstream of pressure reducing device 64, if used. Further, it can be advantageous for gas accumulator 62 to be closer to downstream end 70 than upstream end 68 or even adjacent to downstream end 70. Gas accumulator 62 is connected in fluid flow communication with pipe 60 through orifice union device or pipe 72 but is otherwise a closed container. Gas accumulator 62 defines a gas accumulation zone where extraneous gas from pipe 60 is pushed by the primary gas, as further described below. Gas accumulator 62 can be any suitable shape. The gas accumulator 62 is used as a storage tank to allow the extraneous gas purged from pipe 60 to be segregated so that primary gas can be more quickly delivered to the primary gas utilization device.

Pressure reducing device 64 is connected in line to pipe 60 downstream from gas accumulator 62 and, generally, adjacent to downstream end 70 and gas accumulator 62. Pressure reducing device 64 generates a backpressure upstream from the pressure reducing device and reduces the pressure of primary gas passing downstream from the pressure reducing device. Pressure reducing device 64 can be any such device that accomplishes this function. In one embodiment, pressure reducing device 64 is an orifice union device of the type that is a pipe section with a restrictive orifice, i.e., an orifice that is less than the inner diameter of pipe 60. Generally, the size of the orifice can depend on such factors as: the design pressure of the primary gas at introduction to pipe 60, the desired flow rate of the primary gas through pressure reduction device 64, the inner diameter of pipe 60 and the desired pressure in the downstream end 70 of fuel pipe 60, i.e., the pressure needed at primary gas utilization device 22. It is desirable that the size of the orifice for orifice union device 72 be greater than the size of the orifice for pressure reducing device 64 in order for at least a portion, and preferably a major portion, of the extraneous gas purged from pipe 60 to be directed into gas accumulator 62.

The distribution system illustrated in FIG. 1 is applicable to any system where an extraneous gas needs to be rapidly purged from a system in order to supply primary gas from a primary gas source to a primary gas utilization device. Accordingly, prior to operation the distribution system illustrated in FIG. 1 is loaded with an extraneous gas, which, for example, can result from air displacing the primary gas during shutdown of the primary gas utilization device; from a purge of the primary gas during shut down; or from utilization of a secondary gas that is used in series with the primary gas. Prior to operation, valve 30 is in its off position.

At the start of operation valve 30 is turned to its on position, thus starting the flow of primary gas into pipe 60. It is desirable that the primary gas be of sufficiently high pressure and have sufficient velocity to push the extraneous gas ahead of it in pipe 60 and force a portion of the extraneous gas into gas accumulator 62. Generally, the pressure and velocity should be great enough to force a major portion of the extraneous gas into gas accumulator 62 and only a minor portion through downstream end 70 of pipe 60. Accordingly, to achieve sufficient velocity and force the major portion of the extraneous gas into gas accumulator 62, the primary gas can be higher in pressure than the pressure of the extraneous gas in pipe 60 just prior to operation of the distribution system. Moreover, the primary gas can be at a substantially higher pressure than the extraneous gas in pipe 60. Generally, the primary gas can be more than about 10 psi higher in pressure than the extraneous gas in pipe 60. More typically, the primary gas can be more than about 20 psi and can be more than 30 psi higher than the extraneous gas in pipe 60.

Figure 4:
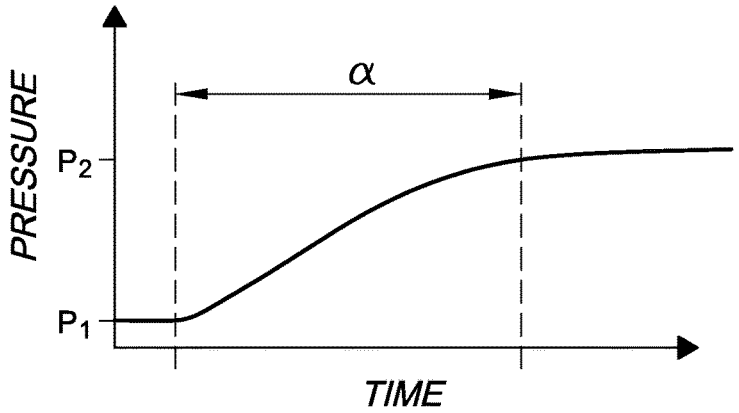
FIG. 4 is a graphical illustration representative of pressure vs. time in pipe 60 of the gas distribution system of FIG. 1.

The introduction of primary gas into pipe 60 can be best understood with reference to FIG. 4, which shows a pressure time graph similar to what would be expected in pipe 60 of the distribution system of FIG. 1. In FIG. 4, the pressure within pipe 60 starts at the x-axis at the pressure $P_1$, which is the pressure of the extraneous gas in pipe 60 prior to introduction of the primary gas. Upon introduction and for transient period $\alpha$, the pressure builds in pipe 60 until it reaches a steady state operating pressure $P_2$. The extraneous gas will be held in gas accumulator 62 at the pressure $P_2$ during operation of the gas distribution system. Accordingly, gas accumulator 62 should be designed with sufficient volume to hold the amount of extraneous gas in the pipe 60 at the pressure $P_2$.

In some cases, the pressure of the primary gas will be greater than demanded by primary gas utilization device 22. In these cases, pressure reduction device 64 can be utilized to reduce the pressure of the gas downstream of pressure reduction device 64 to the pressure suitable for primary gas utilization device 22 and, hence, provide delivery of the primary gas at the pressure required by primary gas utilization device 22. Additionally, because the orifice of pressure reducing device 64 is smaller than the inner diameter of pipe 60 and smaller than the orifice of orifice union device 72, pressure reducing device 64 aids in sequestering a major portion of the extraneous gas in gas accumulator 62 by creating a backpressure, which helps channel extraneous gas into gas accumulator 62.

Figure 2:
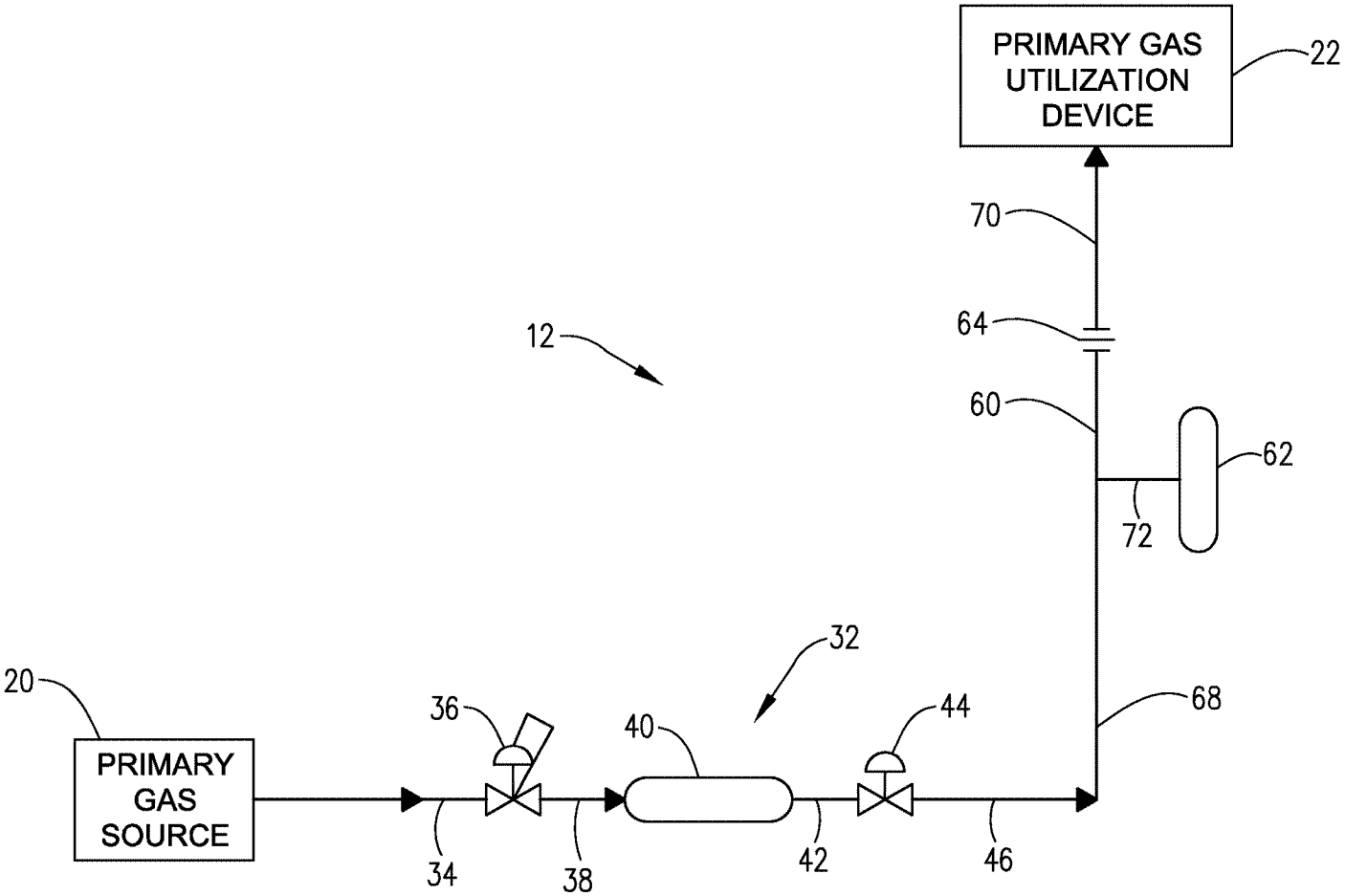
FIG. 2 is a schematic diagram of a second embodiment of a distribution system according to the current invention.

Turning now to FIG. 2, a second embodiment of the gas distribution system of the current invention is illustrated. The distribution system 12 is similar to distribution system 10 that is illustrated in FIG. 1 with the addition of a surge section 32. Accordingly, like components have been given the same reference numerals as in FIG. 1.

Surge section 32 is located between primary gas source 20 and pipe 60 and is in fluid flow communication with both. Surge section 32 is in fluid flow communication with primary gas source 20 via conduit 34 and with pipe 60 via conduit 46. Surge section 32 comprises surge accumulator 40, valve 44 and conduits 34, 38, 42 and 46 and, additionally, can have a pressure regulator 36. If used, pressure regulator 36 can be a pressure regulator as known in the art that allows a suitable high pressure feed (in the sense that it is greater than the pressure of the extraneous gas in pipe 60 prior to operation of the distribution system) to flow from conduit 34 to conduit 38. Pressure regulator 36 is in fluid flow communication with primary gas source 20 via conduit 34 and with surge accumulator 40 via conduit 38. Surge accumulator 40 in turn is in fluid flow communication with valve 44 via conduit 42. Valve 44 has an on position, which allows fluid to flow from conduit 42 to conduit 46 and, hence, into pipe 60. Valve 44 has an off position, which prevents fluid flow from conduit 42 to conduit 46.

Together, pressure regulator 36, surge accumulator 40 and valve 44 can provide a surge of high-pressure primary gas to pipe 60 followed by a constant feed of primary gas to pipe 60. Prior to operation of distribution system 12, valve 44 will be in the off position and pressure regulator 36 will be set to allow high pressure primary gas to pass. Thus, surge accumulator 40 will be charged with a predetermined volume of high-pressure primary gas, the predetermined volume being sufficient to purge pipe 60 of extraneous gas. When distribution system 12 is started, valve 44 will be placed in its on position to allow the surge of high-pressure primary gas to pass into pipe 60.

Figure 5:
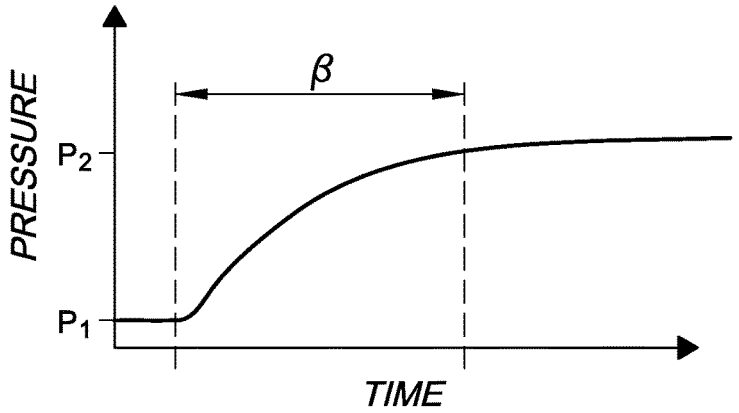
FIG. 5 is a graphical illustration representative of pressure vs. time in pipe 60 of the gas distribution system of FIG. 2.

Additionally, a check valve (not shown) can be used before surge accumulator 40 to prevent back flow. Accordingly, once the initial surge has passed through pipe 60, a constant pressure regulated stream of primary gas at operating pressure will flow into pipe 60. FIG. 5 shows a pressure vs. time graph similar to what would be expected in pipe 60 of the distribution system of FIG. 2. In FIG. 5, the pressure within pipe 60 starts at the x-axis at the pressure $P_1$, the pressure of the extraneous gas in pipe 60 prior to introduction of the primary gas. Upon introduction and for transient period $\beta$, the pressure builds in pipe 60 until it reaches a steady state operating pressure $P_2$. The extraneous gas will be held in gas accumulator 62 at the pressure $P_2$ during operation of the gas distribution system. Accordingly, gas accumulator 62 should be designed with sufficient volume to hold the amount of extraneous gas in the pipe 60 at the pressure $P_2$. It should be noted from FIGS. 4 and 5 that transient period $\beta$ is less than transient $\alpha$, because distribution system 12 is able to more quickly purge the extraneous gas and achieve operating pressure. Accordingly, the surge of primary gas more quickly and efficiently purges extraneous gas from pipe 60 and sequesters it in gas accumulator 62 by more quickly flowing primary gas through pipe 60 and, thus, more quickly bringing the gas in pipe 60 up to the operating pressure.

Figure 3:
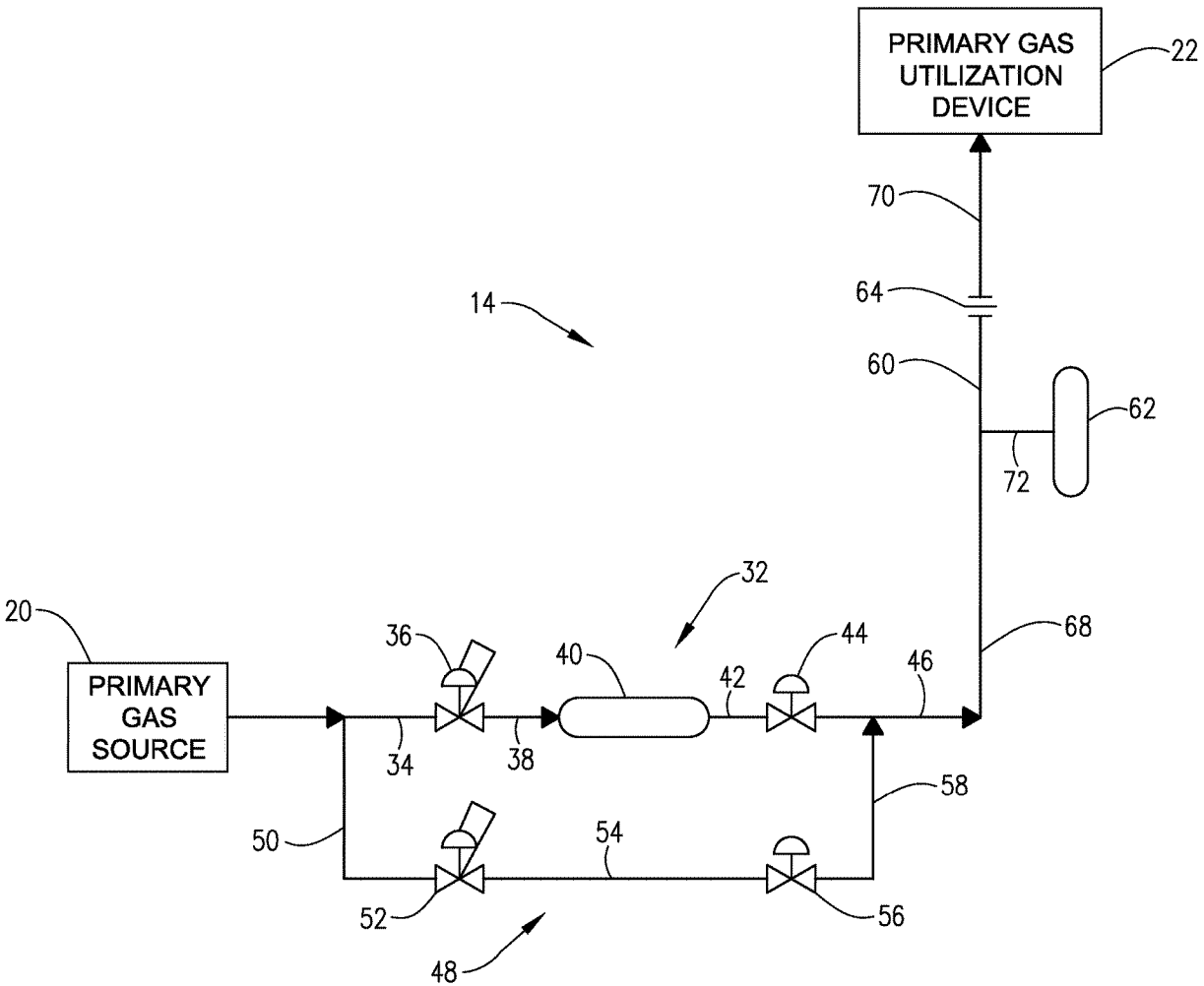
FIG. 3 is a schematic diagram of another embodiment of a distribution system according to the invention.

Turning now to FIG. 3, another embodiment of the gas distribution system of the current invention is illustrated. The distribution system 14 is similar to distribution system 12 that is illustrated in FIG. 2 with the addition of second pressure line 48. Accordingly, like components have been given the same reference numerals as in FIGS. 1 and 2.

Second pressure line 48 is located between primary gas source 20 and pipe 60 and is in fluid flow communication with both and in parallel with surge section 32. Second pressure line 48 is in fluid flow communication with primary gas source 20 via conduit 50 and with pipe 60 via conduits 58 and 46. Second pressure line 48 comprises pressure regulator 52, valve 56 and conduits 50, 54 and 58. Pressure regulator 52 is in fluid flow communication with primary gas source 20 via conduit 50 and with valve 56 via conduit 54. Valve 56, in turn, is in fluid flow communication with conduit 46 and, hence, pipe 60 via conduit 58. Valve 56 has an on position, which allows fluid to flow from conduit 54 to conduit 58 and, hence, into conduit 46 and then pipe 60. Valve 56 has an off position, which prevents fluid flow from conduit 54 to conduit 58.

Surge section 32 and second pressure line 48 are adapted so that the primary gas accumulates in surge accumulator 40 at a pressure $P_3$ prior to operation of the delivery system. They are also adapted such that when valve 56 is in the on position, second pressure line 48 allows the flow of primary gas at pressure $P_2$ from the primary gas source 20 to pipe 60. Pressure $P_3$ is greater than pressure $P_2$. Surge section 32 and second pressure line 48 can each use a pressure regulator, such as illustrated in FIG. 3, or there can be a single pressure regulator 52. It will be appreciated that the primary gas source 20 can supply primary gas at least at pressure $P_3$ to both conduit 34 and 50 and that pressure regulator 52 will decrease the pressure of the primary gas flowing through second pressure line 48 to pressure $P_2$.

Figure 6:
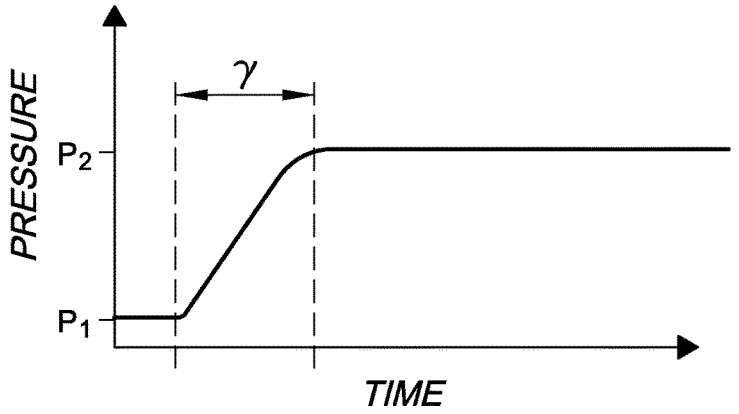
FIG. 6 is a graphical illustration representative of pressure vs. time in pipe 60 of the gas distribution system of FIG. 3.

Prior to operation of distribution system 14, valves 44 and 56 will be in the off position and pressure regulator 36 will be set to allow pressurized primary gas to pass. Thus, surge accumulator 40 will be charged with a predetermined volume of pressurized primary gas at pressure $P_3$. It should be noted that typically both pressure $P_2$ and $P_3$ are above the extraneous gas pressure $P_1$ and that pressure $P_2$ is the steady state operating pressure. The predetermined volume of primary gas in surge accumulator 40 can be sufficient to purge pipe 60 of extraneous gas. When distribution system 14 is started, valve 44 will be placed in its on position to allow the surge of pressurized primary gas to pass into pipe 60. Subsequently, valve 56 can be placed in its on position and valve 44 placed in its off position when the delivery system is running at steady state. FIG. 6 shows a pressure vs. time graph similar to what would be expected in pipe 60 of the distribution system of FIG. 3. In FIG. 6, the pressure within pipe 60 starts at the x-axis at the pressure $P_1$, the pressure of the extraneous gas in pipe 60 prior to introduction of the primary gas. Upon introduction and for transient period $\gamma$, the pressure builds in pipe 60 until it reaches a steady state pressure $P_2$. Pressure $P_3$ can be selected such that the expansion of the primary gas accumulated in surge accumulator 40 results in pipe 60 being brought up to steady state or operating pressure $P_2$. It will be appreciated that once this initial surge has occurred, the primary gas can be provided through second pressure line 48 at operating pressure $P_2$. It should be noted from FIGS. 4, 5 and 6 that transient period γ is less than both transient period β and transient period α. Accordingly, delivery system 14 is able to even more quickly and efficiently purge the extraneous gas and achieve the steady state operating pressure.

Figure 7:
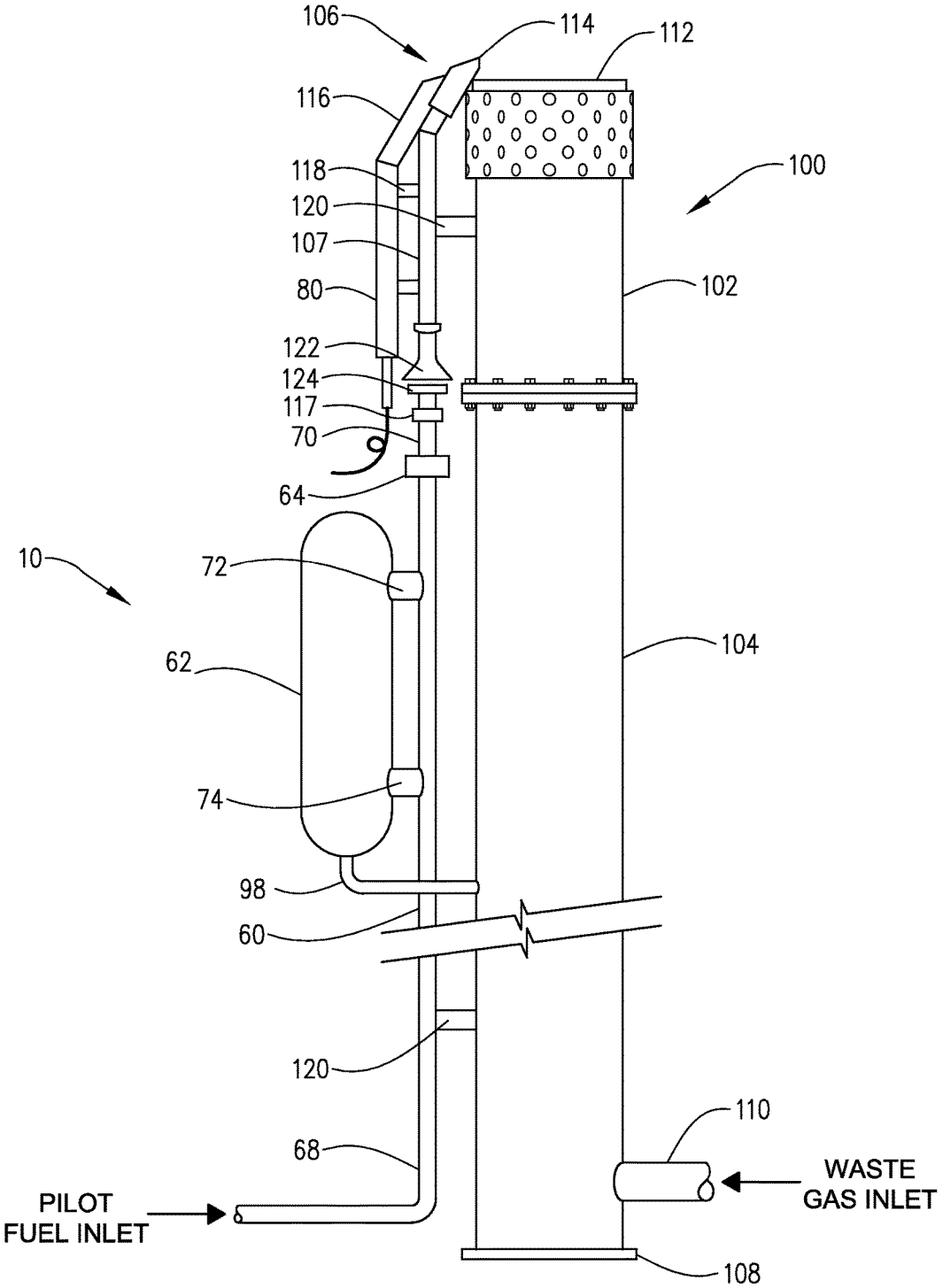
FIG. 7 is an elevation view of one embodiment of a flare stack using a flare pilot distribution system according to the current invention.

Turning now to FIG. 7, a specific application of the inventive gas exchange system will be discussed. In the discussion, components will be referred to by the same numerals as like components discussed above for FIGS. 1-3. FIG. 7 is an elevation view of a flare stack in which the invention can be useful. In FIG. 7 the flare stack is generally designated by the numeral 100. The flare stack 100 includes a flare burner 102, a stack 104, pilot 106 and fuel distribution system 10. While the heights of flare stacks vary depending upon various factors, most flare stacks utilized in production, refining and processing plants range in height from about 20 feet to as high as about 600 feet. The generally tall height of such flare stacks makes the pilot and distribution system subject to relatively long purges (when compared to the demand of flare start-up) if the pilot system is used intermittently instead of continuously. Such purges are necessary because air accumulates in the pilot and distribution system of the pilot system during shut down. As mentioned above, most flare stacks are operated on demand for disposing of combustible wastes or other combustible fluid streams such as hydrocarbon streams, which are diverted during venting, shut-downs, upsets and/or emergencies but the flare stack must be capable of receiving and flaring combustible streams at any time. Accordingly, past pilots have been run continuously. The current invention can be advantageously used to supply fuel to such pilots and provide rapid purge of air that has built up in the distribution system during shut down to allow on demand or intermittent lighting of the pilot.

Turning again to FIG. 7, the bottom end of the stack 104 is closed by a ground level base plate 108. One or more waste or other combustible fluid inlet pipes 110, located at or near ground level, are connected to the stack 104. The flare burner 102 (also sometimes referred to as a flare tip) has open discharge end 112 with at least one pilot 106 positioned adjacent the open discharge end 112. Pilot 106 is connected in fluid flow communication with downstream end 70 of pipe 60, which provides a gaseous fuel to the pilot. Pilot 106 will generally have a discharge nozzle 114 and igniter 116. Fuel from pipe 60 is discharged through discharge nozzle 114 and can be ignited by igniter 116. Discharge nozzle 114 and igniter 116 can be any suitable nozzle and igniter known in the art. Igniter 116 can be attached to pilot pipe 107 by brackets 118 and, in turn, pilot pipe 107 can be attached to flare stack 100 by brackets 120. Similarly, pipe 60 can be attached to flare stack 100 by brackets 120.

Pilot 106 can have a fuel-air mixer 122 located downstream of the junction 117 between downstream end 70 of pipe 60 and pilot 106. Fuel-air mixer 122, which is typically a venturi mixer type of fuel-air mixer, is connected to pilot pipe 107 at a conventional location. Fuel-air mixer 122 will be downstream from gas accumulator 62 and, if used, pressure reducing device 64. Fuel-air mixer 122 can have a pressure reduction device 124 associated with it and upstream from the venturi mixer or other suitable fuel-air mixer. Pressure reduction device 124 reduces the pressure of the fuel prior to the fuel being introduced to the venturi mixer; generally, the pressure reduction device will reduce the pressure to about atmospheric pressure. As is well understood, the fuel is mixed with aspirated atmospheric air as it flows through the mixer 122 and the resulting fuel-air mixture passes to nozzle 114.

Distribution system 10 in FIG. 7 is substantially as described above for FIG. 1. Upstream end 68 of pipe 60 is in fluid flow contact with a primary gas source. In the case of a distribution system for a pilot, the primary gas is generally a gaseous fuel, such as natural gas, propane, refinery gas or the like. Downstream end 70 of pipe 60 is in fluid flow contact with pilot 106. Gas accumulator 62 is connected in fluid flow communication to the pipe 60 between upstream end 68 and downstream end 70. Generally, gas accumulator 62 can be located upstream from and adjacent to pressure reduction device 64, which can be close to, and preferably adjacent to, junction 117. Such a location for gas accumulator 62 can help maximize the sequestering of air in gas accumulator 62.

Gas accumulator 62 is attached to pipe 60 by bracket or sealed pipe 74 and is connected in fluid flow communication with pipe 60 through an orifice union device or pipe 72 but is otherwise generally a closed container. Gas accumulator 62 defines a gas accumulation zone where air from pipe 60 is pushed by the pressurized fuel, as further described below. Gas accumulator 62 can be any suitable shape. The gas accumulator 62 is used as a storage tank to allow the gas purged from pipe 60 to be segregated so that fuel can be more quickly delivered to the pilots. In one embodiment, gas accumulator 62 is in fluid flow communication with stack 104 through capillary conduit 98. Capillary conduit 98 has a small inner diameter compared with orifice union device 72 to provide a bleed off of air from gas accumulator 62 into stack 104. This bleed off of air can help prevent air from flowing back into pipe 60 in the case of a pressure fluctuation of the fuel in pipe 60. Accordingly, the flow rate through capillary conduit 98 should be such that it does not adversely affect the function of supplying fuel to the pilot 106 or of sequestering air in gas accumulator 62 during the initial surge of fuel into pipe 60. Capillary conduit 98 is shown to be attached to gas accumulator 62 at the bottom but can be located at the top or midsection depending on the overall system design, such as the type of fuel utilized.

Optionally, pressure reducing device 64 is connected in line to pipe 60 and downstream from gas accumulator 62. Pressure reducing device 64 generates a backpressure upstream from said pressure reducing device and reduces the pressure of fuel passing downstream from said pressure reducing device. Pressure reducing device 64 can be any such device that accomplishes this function. In one embodiment, pressure reducing device 64 is an orifice union device of the type that is a pipe section with a restrictive orifice, i.e., an orifice that is less than the inner diameter of pipe 60. Generally, the size of the orifice can depend on such factors as: the design pressure of the primary gas at introduction to pipe 60, the desired flow rate of the primary gas through pressure reduction device 64, the inner diameter of pipe 60 and the desired pressure in the downstream end 70 of fuel pipe 60, i.e., the pressure needed at the entrance to pilot 106. It is desirable that the size of the orifice for orifice union device 72 be greater than the size of the orifice for pressure reducing device 64 in order for at least a portion, and preferably a major portion, of the gas purged from pipe 60 to be directed into gas accumulator 62.

In operation, the flare pilot system illustrated in FIG. 7 is capable of rapidly purging the distribution system and pilot of air or an inert gas and igniting the flare pilot so that the flare pilot can be shut down when there is no flare stack discharge without hampering safety or environmental concerns. Accordingly, when there is no waste gas to burn in the flare stack, the flare pilot can be shut down even though during this shut down time, air can enter into flare pilot system, displacing fuel from pipe 60 either partially or fully.

When it is necessary to combust a waste fluid stream in the flare stack, fuel from a fuel source is provided to upstream end 68 of pipe 60. The fuel will be above atmospheric pressure. This high-pressure fuel rapidly displaces the extraneous gas, in this case air or an inert gas, in fuel pipe 60 as it travels towards downstream end 70. The high-pressure fuel pushes the extraneous gas ahead of it. Because the distribution system and pilot together will have one or more pressure reducing devices and their orifices will be smaller than the inner diameter of pipe 60 and the orifice of orifice union device 72, a major portion of the gas is accumulated in gas accumulator 62 and a minor portion exits downstream of the pressure reducing device.

In circumstances where pressure reduction device 64 is not used, the steady state pressure $P_2$ in pipe 60 will be above atmospheric and generally will be above about 3 psig and can be from 3 psig to 20 psig or can be from 7 psig to 15 psig. In cases where reducing device 64 is utilized, the delivery system can provide for more rapid displacement of the extraneous gas. Generally, in this case the steady state pressure will be above about 20 psig and can be up to and even greater than 100 psig. Typically, the steady state pressure can be from 20 psig to 100 psig and can be from 30 psig to 70 psig. Fuel pressure downstream from pressure reducing device 64 will generally be from about 3 to about 20 psig. Generally, the high-pressure fuel will be introduced into pipe 60 at a high velocity on the order of sonic velocity. This velocity can be 800 ft/sec or more and can be about 1100 ft/second or more. Typically, this velocity can be from 800 ft/sec to 1200 ft/sec. The velocities recited are at initial introduction or initial surge of the fuel into pipe 60 and will decay as the steady state pressure is approached in pipe 60. It should be understood that the pressures and velocities recited, while typical of the pilot and inventive distribution system described, depend on the internal diameter of pipe 60 and other features that one skilled in the art will readily appreciate and understand from the description herein.

Figure 8:
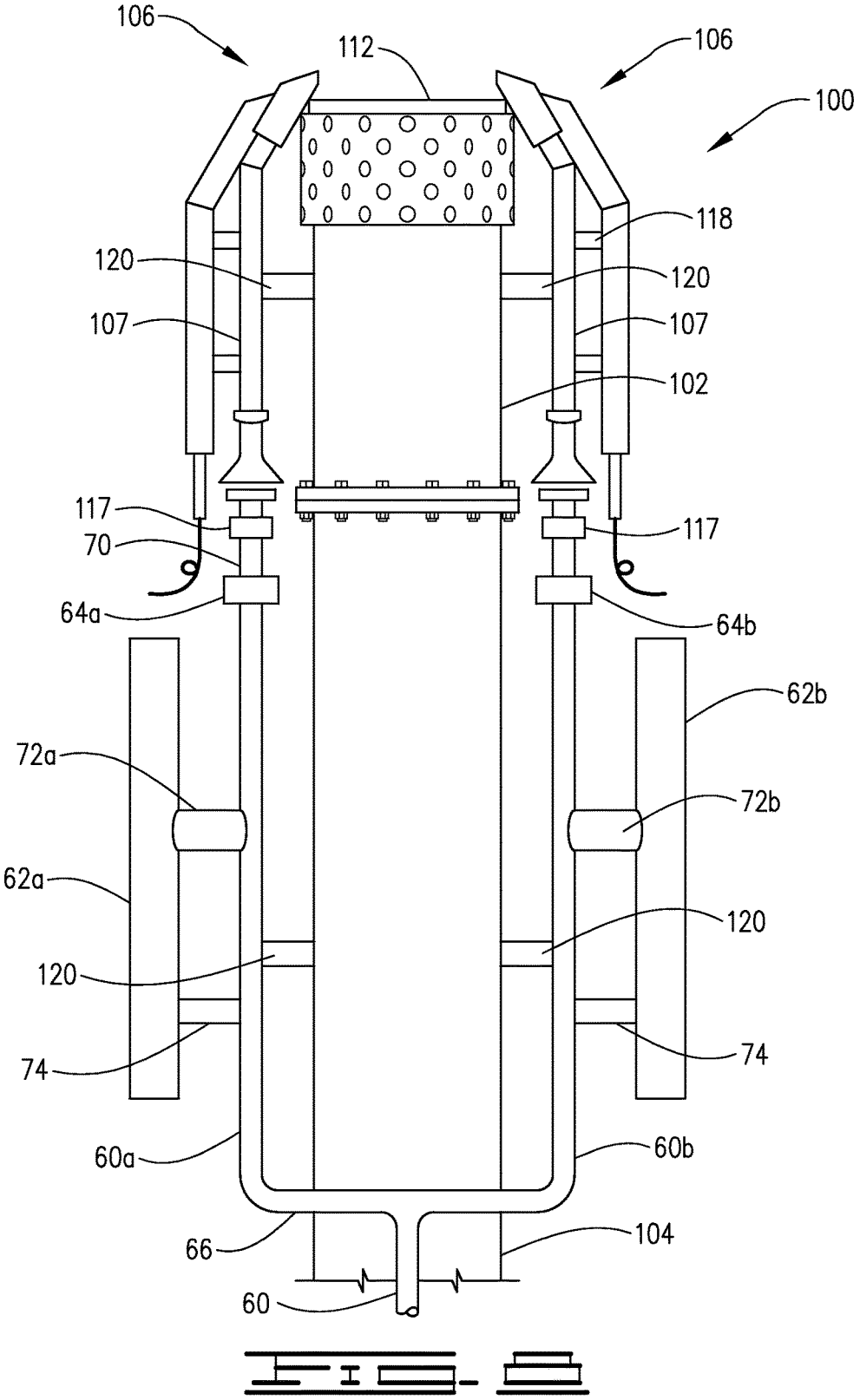
FIG. 8 is an elevation view of one embodiment of a flare stack using a flare pilot distribution system according to the current invention. The flare pilot has two gas accumulators and two flare pilots.
Figure 3:
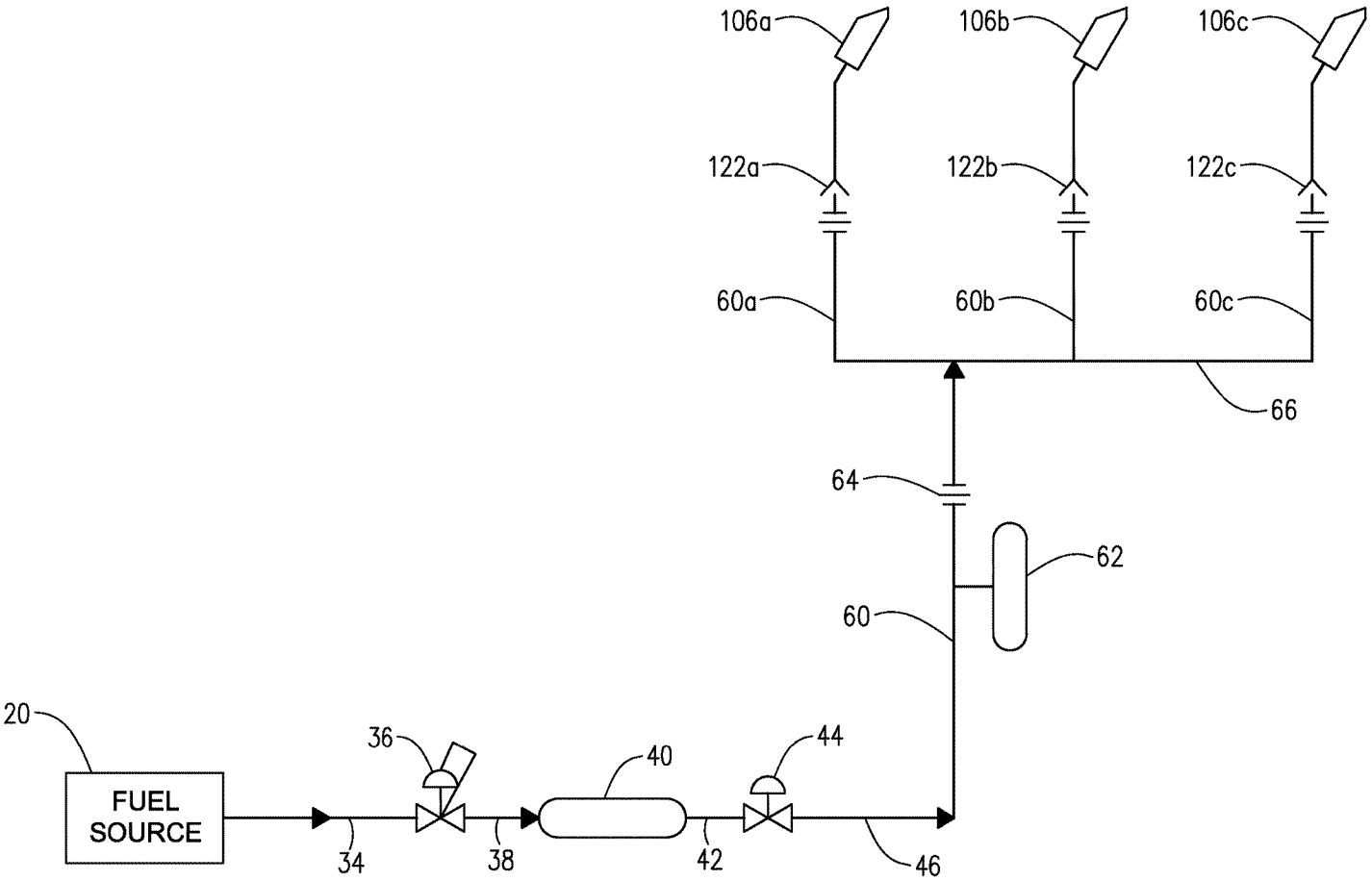
Figure 7:
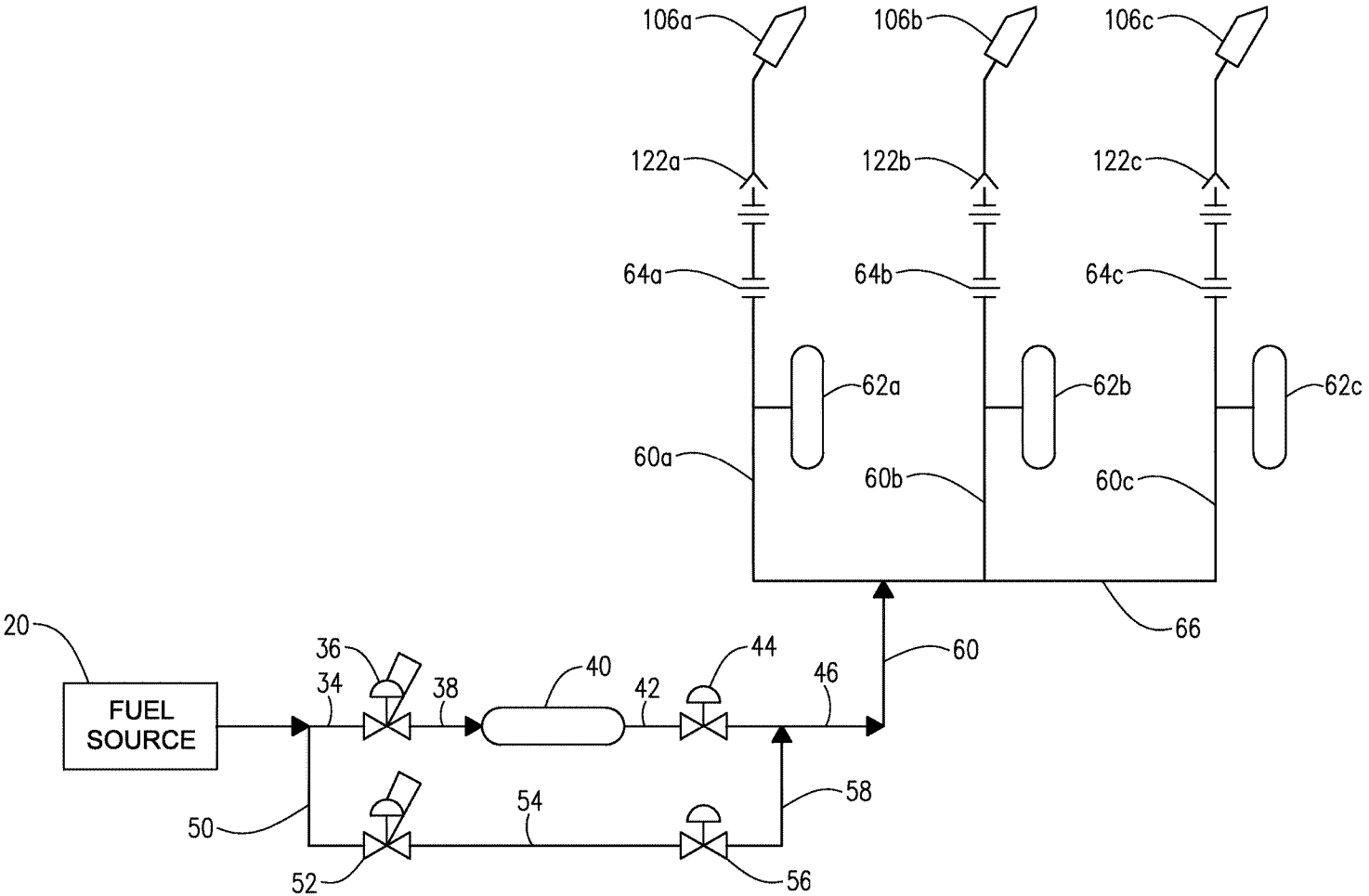

Additional, non-limiting examples of the inventive distribution system as applied to a pilot for a flare stack are illustrated in FIGS. 8-10. FIG. 8 is an elevation view of a flare stack with two pilots using the inventive system. In FIG. 8 each pilot has a gas accumulator 62*a* or 62*b* located upstream from it and, optionally, pressure reduction device 64*a* and 64*b*. Upstream from gas accumulators 62*a* and 62*b* is a distributor 66, which distributes fuel from pipe 60 to pipes 60*a* and 60*b*.

FIG. 9 is a schematic illustration of distribution system 12 from FIG. 2 used in conjunction with three pilots for a flare stack. The embodiment illustrated in FIG. 9 uses a single gas accumulator 62 and pressure reduction device 64 located upstream from distributor 66. In the embodiment of FIG. 9, fuel in surge accumulator 40 will generally be at the steady-state operating pressure of pipe 60 or higher and can be at a pressure greater than 20 psig. Further, the pressure can be from 20 to 100 psig and can be from 30 psig to 70 psig.

FIG. 10 is a schematic illustration of distribution system 14 from FIG. 3 used in conjunction with three pilots for a flare stack. The embodiment illustrated in FIG. 10 uses gas accumulators 62*a*, 62*b* and 62*c* and pressure reduction device 64*a*, 64*b* and 64*c* located downstream from distributor 66. In the embodiment of FIG. 10, fuel in surge accumulator 40 can be at the steady state operating pressure of pipe 60 but will generally be higher than the steady state operating pressure of pipe 60. For example, if the steady state operating pressure is from 20 psig to 60 psig, the fuel in surge accumulator 40 can be from 30 psig to 100 psig and, if the steady state operating pressure is from 30 to 70 psig, the fuel in surge accumulator 40 can be from 40 to 100 psig; provided that the pressure of the fuel in surge accumulator 40 is greater than the steady state operating pressure. The foregoing pressures are exemplary and one skilled in the art will understand that higher pressures can be utilized.

In order to further illustrate the flare pilot system of this invention, its operation and the methods of the invention, the following examples are given.

EXAMPLES

Test Set Up

A single pilot was run off of a single gas riser supplying fuel gas through a distribution header. Fuel was initially held in a 2-inch pipe header. A manual valve controlled the delivery of fuel from the header into the distribution system. Just downstream of the valve was located a check valve and a purge port in which nitrogen could be applied to the system. Nitrogen was used to ensure the distribution system was completely purged of fuel gas and totally inert before each test point. The distribution assemble comprised a stainless steal coil three hundred feet in length to mimic the pilot piping normally associated with a 300 ft flare stack. The coil had a 0.5 inch outer diameter with a 0.032 inch wall thickness. At the end of the three hundred foot coil was an accumulator tank and an in line pressure reduction device used to step the pressure down to 15 psig downstream of the device for entry into the pilot. This device was removable so that the system could utilize full line pressure, if wanted. The pressure reduction device was closely coupled with the accumulator tank to ensure a rapid interaction between the two devices and the flowing gas. Downstream of the pressure reduction device a single pilot was connected to the distribution system. The pilot included a pilot orifice that stepped down the pressure to approximately atmospheric.

As used in the examples below, the line pressure was the pressure of the fuel in the coil upstream from the accumulator and pressure reduction device.

Example 1

The test setup described above was utilized, except that the accumulator tank and pressure reduction device were not utilized. Fuel was introduced so that the line pressure was 18 psig. The results are reported in Table 1 below.

Example 2

The test setup described above was utilized including the accumulator tank but not utilizing the pressure reduction device. Fuel was introduced so that the line pressure was 15 psig. The results are reported in Table 1 below.

Example 3

The test setup described above was utilized including the accumulator tank and the pressure reduction device. Fuel was introduced so that the line pressure was 30 psig. The results are reported in Table 1 below.

Example 4

The test setup described above was utilized including the accumulator tank and the pressure reduction device. Fuel was introduced so that the line pressure was 65 psig. The results are reported in Table 1 below.

TABLE 1

| | Example 1 | Example 2 | Example 3 | Example 4 |
|---|---|---|---|---|
| Line Pressure (psig) | 18 | 15 | 30 | 65 |
| Accumulator Tank | Not Utilized | Utilized | Utilized | Utilized |
| Pressure Reduction Device | Not Utilized | Not Utilized | Utilized | Utilized |
| Pilot Orifice | #53 MTD | #53 MTD | #53 MTD | #53 MTD |
| Number of Pilots | 1 | 1 | 1 | 1 |
| Ignition Time Interval (sec) | 17.8 | 8.4 | 5.8 | 4.65 |

A typical distribution and pilot system in accordance with prior art would have a 1-inch sch. 80 pipe riser. Purging the distribution and pilot system of air would occur at a pressure of 15 psig or less and it would take roughly 1.5 minutes to purge gas in the distribution and pilot system and ignite the pilot (ignition time interval). A 1.25 inch sch. 80 pipe riser would have approximately a 2.5 minute ignition time interval. As can be seen from the above table use of a higher pressure along with a reduced distribution line diameter (Example 1) can result in a significant time reduction. Use of an accumulator (Example 2), even without a higher pressure, also results in a significant time reduction. Use of higher pressure, an accumulator and a pressure reduction device provided for an even more significant time reduction for the ignition time interval.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A method for intermittently operating a pilot for igniting flammable fluids discharged from an open end of a flare stack wherein said pilot receives fuel from a pipe having an upstream end in fluid flow communication with a source of fuel and a downstream end in fluid flow communication with said pilot, said method comprising:

(a) shutting down said pilot when no flammable fluids are being discharged from said flare stack and allowing air at a first pressure, which is about atmospheric pressure, to enter said pilot and said pipe;

(b) introducing a fuel from said fuel source to said upstream end of said pipe when flammable fluids need to be discharged from said flare stack; wherein said fuel is introduced at least at a second pressure greater than atmospheric pressure such that said fuel flows towards said downstream end, thus defining an upstream direction and a downstream direction;

(c) displacing said air by said introduction of said fuel so that air is purged from said pipe and so that at least a portion of said air is displaced into a gas accumulation zone in fluid flow communication with said pipe and, thus, purged from said pipe into said gas accumulation zone without exiting said downstream end of said pipe;

(d) reducing the pressure of said fuel at a point downstream of said downstream end of said pipe such that the pressure of said fuel is about atmospheric; and (e) igniting said fuel as it exits said pilot.

2. The method of claim 1 further comprising:

(f) reducing the pressure of said fuel at a point downstream of said fluid flow communication between said pipe and said gas accumulation zone and upstream of said downstream end such that a backpressure is created upstream from said pressure reduction.

3. The method of claim 2 wherein said second pressure is from 30 psig to 70 psig, said pressure of said fuel after said reducing said pressure in step (f) is from 3 psig to 20 psig and said pressure of said fuel after said reducing said pressure in step (d) is about atmospheric.

4. The method of claim 1 further comprising:

supplying said fuel to a surge accumulation zone capable of storing a predetermined quantity of said fuel at least at said second pressure;

introducing said predetermined quantity of fuel from said surge accumulation zone to said pipe in step (c).

5. The method of claim 4 wherein said predetermined quantity is sufficient to displace said air from said pipe in step (c) such that a major portion of the air is displaced into said gas accumulation zone and displace the thus remaining minor portion of said air through said downstream end.

6. The method of claim 5 further comprising after step (c) supplying a continuous stream of fuel to said pipe at said second pressure.

7. The method of claim 6 wherein said predetermined quantity of fuel is at a third pressure greater than said second pressure.

8. The method of claim 7 further comprising reducing the pressure of said fuel at a point downstream of said fluid flow communication between said pipe and said gas accumulation zone and upstream of said downstream end such that a backpressure is created upstream from said pressure reduction.

9. The method of claim 1 wherein said second pressure is from 30 psig to 70 psig.

10. The method of claim 2 wherein said second pressure is from 30 psig to 70 psig.

11. The method of claim 1, wherein in step (c), said fuel is introduced so as to displace a major portion of said air into said gas accumulation zone and displace the thus remaining minor portion of said air through said downstream end.

12. The method of claim 1, wherein in step (c), said fuel is introduced so as to displace a major portion of said air into said gas accumulation zone and displace the thus remaining minor portion of said air through said downstream end.

13. The method of claim 1, further comprising bleeding said air from said gas accumulation zone so as to prevent said air from flowing back into said pipe.

14. A method for intermittently operating a pilot for igniting flammable fluids discharged from an open end of a flare stack wherein said pilot receives fuel from a pipe having an upstream end in fluid flow communication with a source of fuel and a downstream end in fluid flow communication with said pilot, said method comprising:

(a) shutting down said pilot when no flammable fluids are being discharged from said flare stack and allowing air at a first pressure, which is about atmospheric pressure, to enter said pilot and said pipe;

(b) introducing a fuel from said fuel source to said upstream end of said pipe when flammable fluids need to be discharged from said flare stack; wherein said fuel is introduced at least at a second pressure greater than atmospheric pressure such that said fuel flows towards said downstream end, thus defining an upstream direction and a downstream direction;

(c) displacing said air by said introduction of said fuel so that air is purged from said pipe and so that at least a major portion of said air is displaced into a gas accumulation zone in fluid flow communication with said pipe and, thus, purged from said pipe into said gas accumulation zone without exiting said downstream end of said pipe and the thus remaining minor portion is displaced of said air through said downstream end;

(d) reducing the pressure of said fuel at a point downstream of said downstream end of said pipe such that the pressure of said fuel is about atmospheric;

(e) igniting said fuel as it exits said pilot, and (f) reducing the pressure of said fuel at a point downstream of said fluid flow communication between said pipe and said gas accumulation zone and upstream of said downstream end such that a backpressure is created upstream from said pressure reduction.

15. The method of claim 14, further comprising mixing said fuel with air at a point downstream of reduction of the pressure of said fuel in step (f) and upstream of said reduction of the pressure of said fuel in step (d).

16. The method of claim 14, wherein during step (c) said fuel is at a third pressure higher than said second pressure and, after said major portion of said air is displaced into said gas accumulation zone, pressure of said fuel is reduced to said second pressure.

17. The method of claim 16, further comprising:

prior to step (b) supplying said fuel to a surge accumulation zone capable of storing a predetermined quantity of said fuel at least at said third pressure; and introducing said predetermined quantity of fuel from said surge accumulation zone to said pipe in step (c), wherein said predetermined quantity of fuel is sufficient to displace said air from said pipe such that said major portion of air is displaced into said gas accumulation zone by said predetermined quantity.

18. The method of claim 17, further comprising mixing said fuel with air at a point downstream of reduction of the pressure of said fuel in step (f) and upstream of said reduction of the pressure of said fuel in step (d).

* * * * *